US010888111B2

(12) United States Patent
Grant

(10) Patent No.: US 10,888,111 B2
(45) Date of Patent: Jan. 12, 2021

(54) MULTICOMPONENT AEROSOL-FORMING ARTICLE

(71) Applicant: PHILIP MORRIS PRODUCTS S.A., Neuchatel (CH)

(72) Inventor: Christopher John Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/774,668

(22) PCT Filed: Nov. 10, 2016

(86) PCT No.: PCT/EP2016/077255
§ 371 (c)(1),
(2) Date: May 9, 2018

(87) PCT Pub. No.: WO2017/081144
PCT Pub. Date: May 18, 2017

(65) Prior Publication Data

US 2018/0325167 A1 Nov. 15, 2018

(30) Foreign Application Priority Data

Nov. 12, 2015 (EP) ..... 15194232

(51) Int. Cl.
*A24D 1/02* (2006.01)
*A24D 1/04* (2006.01)

(52) U.S. Cl.
CPC ..... *A24D 1/02* (2013.01); *A24D 1/045* (2013.01)

(58) Field of Classification Search
CPC ..... A24D 1/02; A24D 1/045
See application file for complete search history.

(56) References Cited

U.S. PATENT DOCUMENTS 8,852,350 B2 10/2014 Sampson
2007/0215168 A1* 9/2007 Banerjee ..... A24B 15/165 131/335

(Continued)

FOREIGN PATENT DOCUMENTS

CN 1925757 A 3/2007
EP 2740370 4/2016

(Continued)

OTHER PUBLICATIONS

PCT Search Report and Written Opinion for PCT/EP2016/077255 dated Jan. 16, 2017 (9 pages).

(Continued)

*Primary Examiner* — Eric Yaary
*Assistant Examiner* — Jennifer A Kessie
(74) *Attorney, Agent, or Firm* — Mueting Raasch Group

(57) ABSTRACT

The present invention relates to a multicomponent aerosol-forming article defining a longitudinal axis, the article comprising: —a first rod-shaped component comprising a first longitudinal surface having a first and a second axially opposed ends, said first longitudinal surface being at least partially wrapped around the longitudinal axis in a first wrapping sheet; —a second rod-shaped component comprising a second longitudinal surface having a first and a second axially opposed ends, said second longitudinal surface being at least partially wrapped around the longitudinal axis in a second wrapping sheet, the first end of the second component being in direct abutment to the second end of the first component along said longitudinal axis; —wherein a portion of said second longitudinal surface at said first end of said second component is free of said second wrapping sheet; and—wherein said first wrapping sheet is wrapped for at least an overlapping length along the longitudinal axis on the second wrapping sheet.

19 Claims, 2 Drawing Sheets

(56) References Cited

U.S. PATENT DOCUMENTS

| | | | | |
|---|---|---|---|---|
| 2013/0019888 | A1 | 1/2013 | Tsuruizumi | |
| 2015/0107611 | A1* | 4/2015 | Metrangolo | A24B 13/00 131/329 |
| 2015/0208722 | A1* | 7/2015 | Kadiric | A24C 5/476 131/337 |

FOREIGN PATENT DOCUMENTS

| | | |
|---|---|---|
| RU | 138230 | 3/2014 |
| RU | 2544158 | 3/2015 |
| WO | WO 00/00047 | 1/2000 |
| WO | WO 2005/082180 | 9/2005 |
| WO | WO 2009/109427 | 9/2009 |
| WO | WO 2012076649 | 6/2012 |
| WO | WO 2014/009499 | 1/2014 |

OTHER PUBLICATIONS

Office Action issued in Russia for Application No. 2018121258 dated Dec. 19, 2019 (7 pages).
Office Action issued in China for Application No. 201680059185.0 dated Sep. 16, 2020 (16 pages). English translation included.

* cited by examiner

MULTICOMPONENT AEROSOL-FORMING ARTICLE

This application is a U.S. National Stage Application of International Application No. PCT/EP2016/077255, filed Nov. 10, 2016, which was published in English on May 18, 2017, as International Publication No. WO 2017/081144 A1. International Application No. PCT/EP2016/077255 claims priority to European Application No. 15194232.3 filed Nov. 12, 2015.

The invention is related to a multicomponent aerosol-forming article defining a longitudinal axis.

Aerosol-forming articles which generate aerosol to be inhaled by a user are known. These articles are generally formed by a plurality of components, arranged to define—and extending along—a longitudinal axis.

For example, such components can be two or more of the following rod-shaped elements: a tobacco rod, a Hollow Acetate Tube (HAT), a Poly Lactic Acid (PLA) filter and a Mouth Piece Filter (MPF). Typically, such components are wrapped around the longitudinal axis in wrapping sheet or sheets, for instance made of paper.

Figure 1:
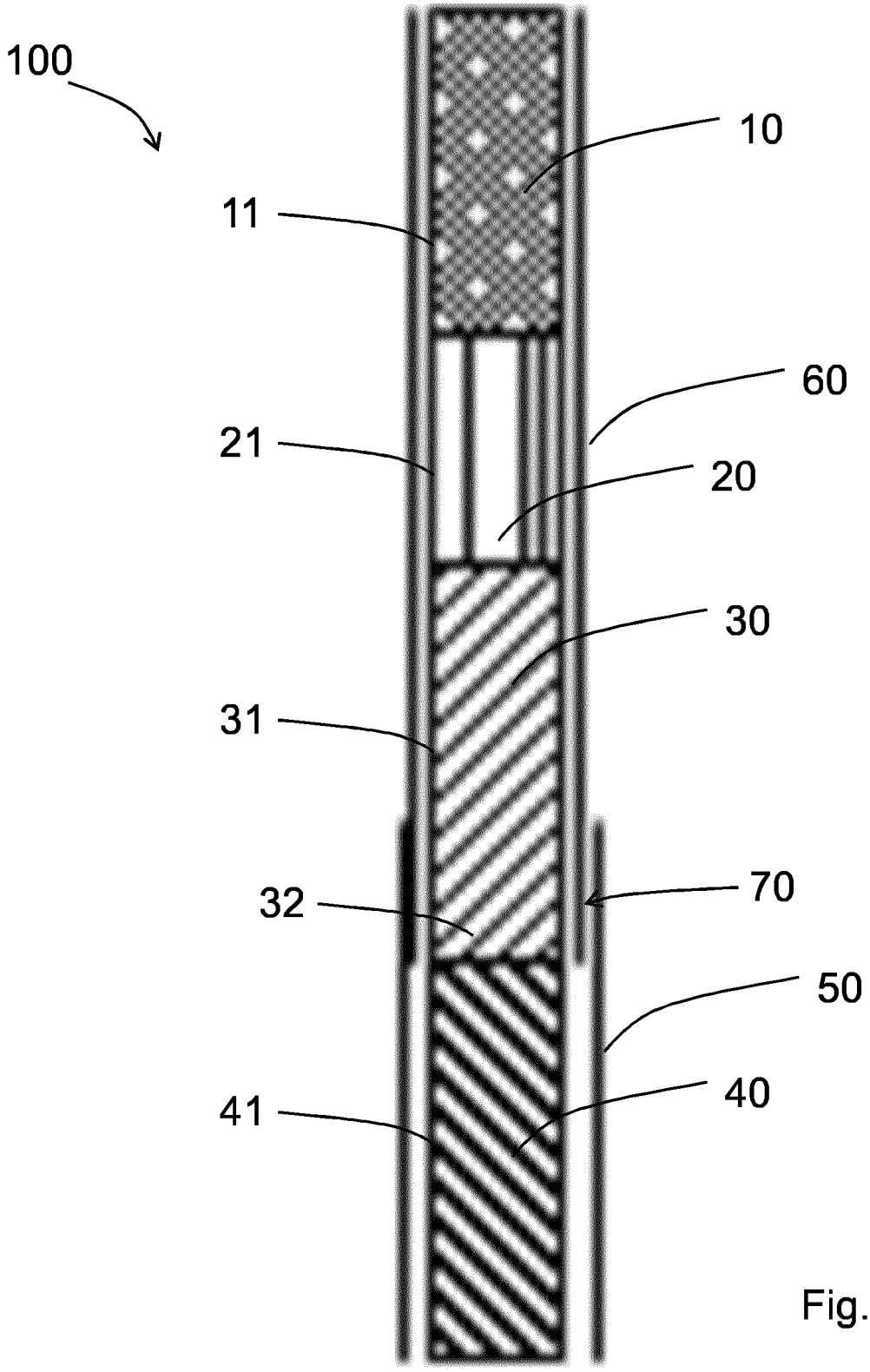

In FIG. 1 shows a known multicomponent aerosol-forming article defining a longitudinal axis having two different wrapping sheets, overlapping in some areas of the multicomponent aerosol-forming article. The multicomponent aerosol-forming article of FIG. 1 includes a tobacco rod 10, a HAT 20, a PLA filter 30, a MPF 40, a first wrapping sheet 50 and a second wrapping sheet 60. The tobacco rod 10, the HAT 20, the PLA filter 30 and the MPF 40 are arranged adjacent each other, that is the tobacco rod 10 is adjacent to the HAT 20, the HAT 20 is adjacent to the PLA filter 30, the PLA filter 30 is adjacent to the MPF 40. The second wrapping sheet 60 wraps longitudinal surfaces of the tobacco rod 10, the HAT 20 ant the PLA filter 30. The first wrapping sheet 50 wraps a longitudinal surface of the MPF 40 and overlaps the second wrapping sheet 60 at an area 70 thereof, which is arranged around the end of the PLA filter 30, wherein such end of the PLA filter 30 is arranged adjacent to the MPF 40.

In order to provide a replicable smoking experience, that is, in order for the user to reproduce the smoking sensation substantially unchanged for each article, there should be no gap or limited gap between the components of such multicomponent aerosol-forming article. Indeed, gaps among the various components may divert air drawn by the user during the smoking and may change the smoking experience.

There is therefore a need for a method of fabrication of multicomponent aerosol-forming articles where the gap formed between the various components is as small as possible.

According to a main aspect, the invention relates to a multicomponent aerosol-forming article defining a longitudinal axis, the article comprising: a first rod-shaped component comprising a first longitudinal surface having a first and a second axially opposed ends, said first longitudinal surface being at least partially wrapped around the longitudinal axis in a first wrapping sheet; a second rod-shaped component comprising a second longitudinal surface having a first and a second axially opposed ends, said second longitudinal surface being at least partially wrapped around the longitudinal axis in a second wrapping sheet, the first end of the second component being in direct abutment to the second end of the first component along said longitudinal axis; wherein a portion of said second longitudinal surface at said first end of said second component is free of said second wrapping sheet; and wherein said first wrapping sheet is wrapped for at least an overlapping length along the longitudinal axis on the second wrapping sheet.

In the multicomponent aerosol-forming article of the invention comprising a first and second rod-shaped component adjacent to each other and wrapped in a first wrapping sheet and in a second wrapping sheet, respectively, substantially no gap may be obtained between the first and second component. The gap between the first and second component is more consistently small or inexistent from one aerosol-forming article to the other on the production line. On the contrary, when a second wrapping sheet is sized so as to cover the whole longitudinal length of the second component, due to the fact that the wrapped second component could have unpredictable slight size changes within acceptable manufacturing tolerance, the longitudinal length of the second wrapping sheet could be a little too long. In such case, the second wrapping sheet can prevent to have a positive and direct contact between the two adjacent components because the extra length of the second wrapping sheet can for instance be placed between the adjacent components and create the unexpected gap. A multicomponent aerosol-forming article defining a longitudinal axis according to the invention may advantageously allow suppressing any gap between the first and the second rod-shaped components and may allow a positive and direct contact between such components which are not wrapped by the same wrapping sheet. Indeed, the fact that the second wrapping sheet has a portion of its longitudinal surface at its first end free from any second wrapping sheet prevents any interposition of a portion of the second wrapping sheet between the first and the second rod-shaped components, avoiding any gap between the first and the second rod-shaped components.

In the following, with the term "component" any element which may be included in an aerosol-forming article is meant. Such elements are known in the art and not further detailed below. For example, such component might include a plug of a filter, a heat source, a menthol capsule, a charcoal element, and so on.

Preferably, one of the components of the multicomponent aerosol-forming article is a segment of a filter of an aerosol-forming article. The filter may be a cellulose acetate filter plug. The filter may have a length of between about 5 millimeters and about 20 millimeters for example of about 7 millimeters in length.

Preferably, one of the components of the multicomponent aerosol-forming article is a tobacco containing component. The tobacco component might contain a tobacco cut filler or an aerosol-forming reconstituted tobacco. One of the components may comprise a tobacco rod to be combusted or heated.

Preferably, one of the components of the multicomponent aerosol-forming article comprises a tobacco-containing material including volatile tobacco flavour compounds, which are released from an aerosol-forming substrate upon heating. The aerosol-forming substrate may comprise, for example, one or more of: powder, granules, pellets, shreds, spaghettis, strips or sheets containing one or more of: herb leaf, fragments of tobacco ribs, reconstituted tobacco, homogenised tobacco, extruded tobacco and expanded tobacco.

Preferably, one of the components of the multicomponent aerosol-forming article may include a heat source, or a volatile flavour generating component, for example a menthol capsule, a charcoal element. The heat source may comprise a combustible high carbon content carbonaceous material and also can include graphite or alumina. The heat source is for example a charcoal element that may be ignited and transfer heat to the aerosol-forming substrate to form an inhalable aerosol.

The volatile flavour generating component may be coupled to a fibrous support element. The fibrous support element may be any suitable substrate or support for locating, holding, or retaining the flavour generating component. The fibrous support element may be, for example, a paper support or a capsule. The fibrous support may be, for example, a thread or twine. Such thread or twine may be saturated in a liquid component, such as liquid menthol. Such a thread or twine may be threaded to or otherwise coupled to a solid flavour generating component. For example, solid particles of menthol may be coupled to a thread.

Each component defines a longitudinal axis. Preferably, the components might be rod shaped.

In the following, the term "length", unless otherwise specified, refers to a length of the component along its longitudinal axis.

In the following, the term "rod" denotes a generally cylindrical element of substantially cylindrical, oval or elliptical cross-section, preferably comprising two or more components of an aerosol-forming article.

Aerosol-forming articles according to the invention may be whole, assembled aerosol-forming articles or components of aerosol-forming articles that are combined with one or more other components in order to provide an assembled article for producing an aerosol, such as for example, the consumable part of a heated smoking device.

As used herein, aerosol-forming article is any article that generates an inhalable aerosol when an aerosol-forming substrate is heated. The term includes articles that comprise an aerosol-forming substrate that is heated by an external heat source, such as an electric heating element. An aerosol-forming article may be a non-combustible aerosol-forming article, which is an article that releases volatile compounds without the combustion of the aerosol-forming substrate. An aerosol-forming article may be a heated aerosol-forming article, which is an aerosol-forming article comprising an aerosol-forming substrate that is intended to be heated rather than combusted in order to release volatile compounds that can form an aerosol. The term includes articles that comprise an aerosol-forming substrate and an integral heat source, for example a combustible heat source.

Aerosol-forming articles according to the present invention may be in the form of filter combustible cigarettes or other smoking articles in which tobacco material is combusted to form smoke.

An aerosol-forming article may be an article that generates an aerosol that is directly inhalable into a user's lungs through the user's mouth. An aerosol-forming article may resemble a conventional smoking article, such as a cigarette and may comprise tobacco. An aerosol-forming article may be disposable. An aerosol-forming article may be partially-reusable and comprise a replenisheable or replaceable aerosol forming substrate.

Preferably, the aerosol-forming article may be substantially cylindrical in shape. The aerosol-forming article may be substantially elongated. The aerosol-forming article may have a length and a circumference substantially perpendicular to the length. The aerosol-forming article may have a total length between about 30 millimeters and about 100 millimeters. The aerosol-forming article may have an external diameter between about 5 millimeters and about 12 millimeters.

Further, a "multicomponent aerosol-forming article" means that the article includes at least two components. Further, "aerosol-forming article" does not mean only complete aerosol-forming articles, but also part thereof.

According to the invention, the aerosol-forming article includes at least two components, a first and a second rod-shaped component. Each component defines a longitudinal surface and a first and second opposite axial ends. The first rod-shaped component, which defines a longitudinal axis, is wrapped around the longitudinal axis in a first wrapping sheet. The second rod-shaped component, which also defines a longitudinal axis, is also wrapped around the longitudinal axis in a second wrapping sheet.

A wrapping sheet, or wrapper, can be any wrapping surrounding the component, including wrappers containing flax, hemp, kenaf, esparto grass, rice straw, cellulose and so forth. Optional filler materials, flavor additives, and burning additives may be included. In production of an aerosol-forming article such as a cigarette, for example, the wrapper is wrapped around the cut filler to form a tobacco rod portion of the aerosol-forming article by a cigarette making machine, which has previously been supplied or is continuously supplied with tobacco cut filler and one or more ribbons of wrapper. When supplied to the cigarette making machine, the wrapper can be supplied from a single bobbin in a continuous sheet (a monowrap) or from multiple bobbins (a multiwrap, such as a dual wrap from two bobbins). Further, the wrapper can have more than one layer in cross-section, such as in a bi-layer or multi-layer paper wrapper. Preferably, the wrapping sheet includes wrapping paper.

The first end of the second component is in direct abutment to the second end of the first component along the longitudinal axis. "Direct abutment" means that the first end of the second component is directly facing or in contact with the second end of the first component without any additional element therebetween. That is to say that the first and second components are adjacent and in contact to each other along the longitudinal axis without any further material between the two. A portion of the second longitudinal surface is "uncovered" by the second wrapping sheet. This uncovered portion is located at the first end of said second component, so that direct abutment to the second end of the first component is possible, being no wrapper present to hinder the contact between the first and second component. Further, the portion of the second component free from the second wrapping paper may not be visible to the exterior of the aerosol-forming article: the first wrapping sheet is wrapped for at least an overlapping length along the longitudinal axis on the second wrapping sheet and therefore also the portion of the second component not-covered by the second wrapping sheet is covered and hidden by the first wrapping sheet.

Due to the fact that a portion of said second longitudinal surface at said first end of said second component is free of said second wrapping sheet, a better contact between different components in an aerosol-forming article may thus be possible. Moreover, the portion of the second rod-shaped component which is not wrapped in the second wrapping sheet is covered and wrapped in the first wrapping sheet, so that this feature may go substantially unnoticed when the multicomponent aerosol-forming article (final product) according to the invention is observed from the outside.

Preferably, the first wrapping sheet is in direct contact with a portion of the first longitudinal surface of the first rod-shaped component. More preferably, the first wrapping sheet is in direct contact with the whole portion of the first longitudinal surface that it wraps. Preferably, the first wrapping sheet is directly in contact to the first component without any additional element therebetween. That is to say that the first wrapper and the first component are preferably adjacent and in contact to each other without any further material between the two, with the possible exception of glue which might be needed to keep the first wrapping sheet fixed on the first component. In particular, preferably, no additional sheet or layer is interposed between the first component and the first wrapping sheet.

Preferably, the second wrapping sheet is in direct contact with a portion of the second longitudinal surface of the second rod-shaped component. More preferably, the second wrapping sheet is in direct contact with the whole portion of the second longitudinal surface that it wraps. Preferably, the second wrapping sheet is directly in contact to the second component without any additional element therebetween. That is to say that the second wrapper and the second component are preferably adjacent and in contact to each other without any further material between the two, with the possible exception of glue which might be needed to keep the second wrapping sheet fixed on the second component. In particular, preferably, no additional sheet or layer is interposed between the second component and the second wrapping sheet.

Preferably, the first wrapping sheet is wrapped around the first longitudinal surface completely.

Preferably, a portion of said second longitudinal surface at said second end of said second component is free of said second wrapping sheet. More preferably, the multicomponent aerosol-forming article comprises a third component, said third component comprising a third longitudinal surface having a first and a second axially opposed ends, the first end of the third component being in direct abutment to the second end of the second component along said longitudinal axis. The multicomponent aerosol-forming article may comprise more than two components, for example a third component may be present as well. The second component may be sandwiched between the first and the third component. In order to have a direct good abutment between all components, preferably the second component has a wrapper-free portion at both its ends, so that the second wrapping sheet—which is wrapped around the second component only—does not hinder the correct contact among the second and third components and among the first and second components.

Advantageously, the second longitudinal surface at said second end is completely covered by said second wrapping sheet, so that an edge of said second longitudinal surface is aligned with an edge of said second wrapping sheet. More preferably, the second end of said second component defines an end of said aerosol-forming article. The second component may be an end component of the aerosol-forming article, that is, the end which forms a mouth piece of the aerosol-forming article, or the opposite end of the article. In this case, advantageously, the second wrapping sheet is covering the whole visible end of the second component till the edge of the second component itself, so that the aesthetic appearance of the article aerosol-forming is not compromised.

Preferably, the second wrapping sheet is wrapped around a plurality of components aligned along said longitudinal axis. The second wrapping sheet may be wrapped around other components in addition to the second component. Not all components need to be wrapped individually, but some of them can be grouped and wrapped together.

The other components wrapped in the second wrapping sheet in addition to the second component may include a third component and a fourth component. The third component may be a Hollow Acetate Tube. The fourth component may be a tobacco rod.

Preferably, the first wrapping sheet is wrapped around no other components than the first and second component. The first wrapping sheet may be wrapped around other components in addition to the first and second component.

Preferably, the second wrapping sheet has a wrapping length along said longitudinal axis shorter than a sum of lengths of aligned longitudinal surfaces along said longitudinal axis of a number of components wrapped by the second wrapping sheet. The second wrapping sheet may be wrapped around one component, the second component, or around more than one component, that is, it may be wrapped around also other components in addition to the second component. The wrapping length of the second wrapping sheet is preferably equal to the shortest theoretical length of the sum of lengths of all components wrapped in the second wrapping sheet minus a safety parameter. The shortest theoretical length is determined by calculating the sum of the theoretical longitudinal lengths of all the components wrapped by the second wrapping sheet along their respective longitudinal axes, and then subtracting to the obtained value the sum of the manufacturing longitudinal lengths tolerances of these components. For instance, if the second wrapping sheet is wrapped around only the second component, for a theoretical length of the second rod-shaped component of about 37.5 millimeters, the shortest theoretical length can be about 37.25 millimeters, that is about 0.25 millimeters less than the theoretical length of the second rod-shaped component, where 0.25 millimeters are the manufacturing tolerances.

Preferably, a sum of the lengths of the components wrapped in the second wrapping sheet along the longitudinal axis is comprised between about 20 millimeters and about 50 millimeters. More preferably, the sum of lengths of the components wrapped in the second wrapping sheet along the longitudinal axis is comprised between about 30 millimeters and about 40 millimeters. Even more preferably, the sum of lengths of the components wrapped in the second wrapping sheet along the longitudinal axis is of about 38 millimeters.

Preferably, said first or said second component is a component of a filter. More preferably, said second component is a filter realized in Poly Lactic Acid. The first or second component may be an end component of the aerosol-forming article.

Preferably, the second wrapping sheet defines an inner diameter when wrapped around said second longitudinal surface. More preferably, the inner diameter of the second wrapping sheet is bigger or equal to a diameter of the second component. Preferably, the inner diameter of the second wrapping sheet or the diameter of the second component is comprised between about 5 millimeters and about 10 millimeters. More preferably, the inner diameter or the diameter of the second component is comprised between about 7.0 millimeters and about 7.2 millimeters. Preferably, an external surface of the aerosol-forming article is substantially smooth without steps or indentation. This smooth surface is obtained wrapping around the components included in the aerosol-forming article with a wrapping sheet, for example including wrapping paper. Typically, the thinner the wrapping paper, the smoother is the external surface. The paper may have a thickness of about 45 microns.

Preferably, the portion of said second longitudinal surface at said first end of said second component free of said second wrapping sheet has a length along said longitudinal axis comprised between about 0.3 millimeters and about 3 millimeters. More preferably, the length of the free portion of second longitudinal surface is comprised between about 0.4 millimeters and about 1.5 millimeters, even more preferably the length of the free portion is of about 0.5 millimeters. It has been found that a free portion having a length in this range could be enough to assure a proper abutment with no or minimal gap, and at the same time a minor overlap of the first wrapping sheet onto the second component is required.

Preferably, a ratio between a length of the portion of said second longitudinal surface at said first end of said second component free of said second wrapping sheet and a length of the second component is comprised between about 0.015 and about 0.2. More preferably, this ratio is comprised between about 0.02 and about 0.1. Even more preferably this ratio is of about 0.028.

Preferably, a ratio between a length of the portion of said second longitudinal surface at said first end of said second component free of said second wrapping sheet and a sum of lengths of all components wrapped by the second wrapping sheet is comprised between about 0.006 and about 0.15. More preferably, this ratio is comprised between about 0.01 and about 0.02. Even more preferably this ratio is of about 0.013.

Preferably, the overlapping length is comprised between about 3 millimeters and about 20 millimeters. More preferably, the overlapping length is comprised between about 8 millimeters and about 15 millimeters. Even more preferably, the overlapping length is of about 13 millimeters.

Preferably, the length along the longitudinal axis of the first component is comprised between about 5 millimeters and 12 millimeters. More preferably, the length of the first component is of about 7 millimeters.

Preferably, said first component is an end component of the multicomponent aerosol-forming. More preferably, the first component includes a mouth piece.

Further, the invention relates to a package containing a plurality of multicomponent aerosol-forming articles realized according to the main aspect. Packages according to the known art in the field of aerosol-forming articles may be used. The packages consistently contain the multicomponent aerosol-forming articles according to the invention so that a substantially uniform smoking experience among all the articles contained in the packages may be obtained.

Figure 2:
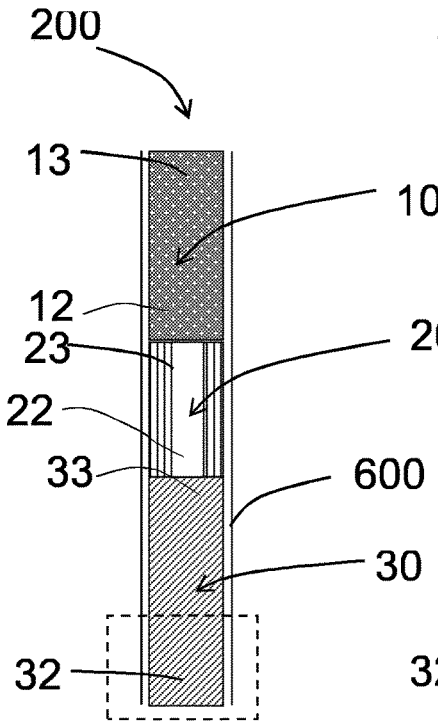
Figure 3:
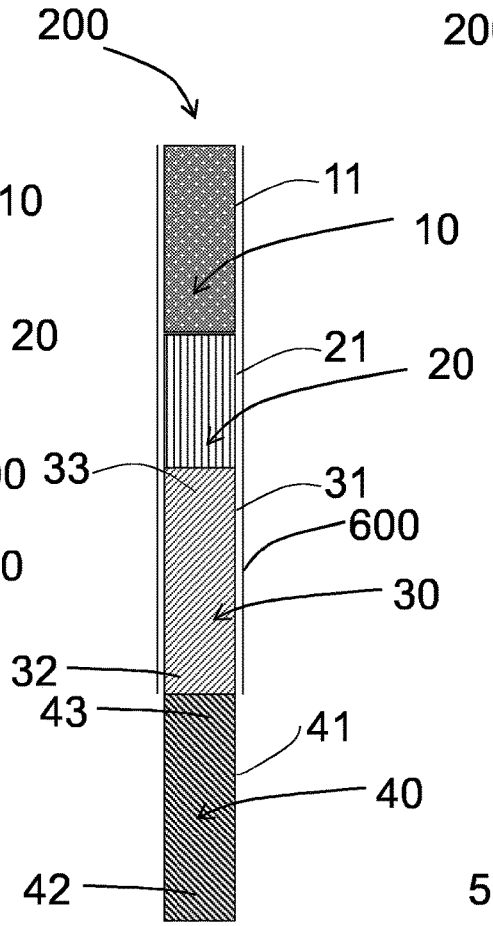
Figure 4:
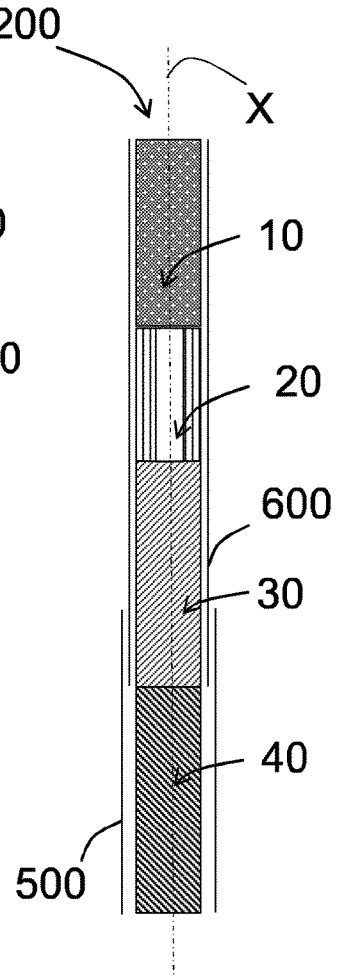
Figure 5:
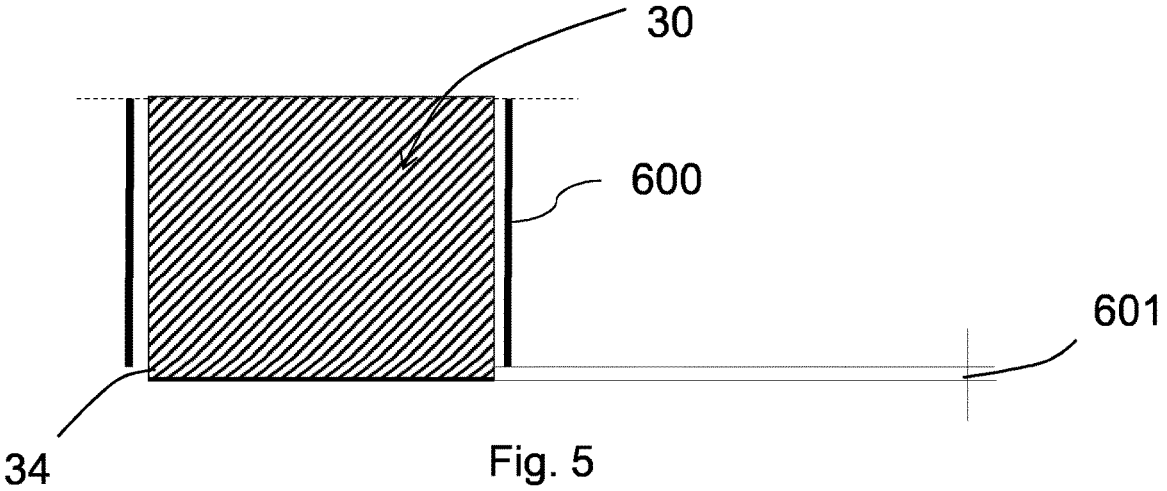

Further advantages of the invention will become apparent from the detailed description thereof with no-limiting reference to the appended drawings:

FIG. 1 is a schematic longitudinal section of a multicomponent aerosol-forming article defining a longitudinal axis according to the prior art;

FIGS. 2-4 are schematic longitudinal sections of a multicomponent aerosol-forming article defining a longitudinal axis according to the present invention, in three successive steps of the manufacture thereof, that is, FIG. 4 is a schematic longitudinal section of the finished multicomponent aerosol-forming article and FIGS. 2 and 3 are schematic longitudinal sections of semi-finished multicomponent aerosol-forming articles; and FIG. 5 is an enlarged, schematic longitudinal section of the portion—squared in dash line—of the semi-finished multicomponent aerosol-forming article of FIG. 2.

In particular, FIG. 1 shows a multicomponent aerosol-forming article defining a longitudinal axis according the prior art, globally indicated with reference number 100.

The multicomponent aerosol-forming article 100 comprises two different wrapping sheets 50 and 60, overlapping in an area 70 (see below) of the multicomponent aerosol-forming article 100.

In particular, the multicomponent aerosol-forming article 100 includes a first component comprising a Mouth Piece Filter (MPF) 40, a second component comprising a Poly Lactic Acid (PLA) filter 30, a third component comprising a Hollow Acetate Tube (HAT) 20, and a fourth component comprising a tobacco rod 10. Further, the multicomponent aerosol-forming article 100 includes and a a first wrapping sheet 50 and a second wrapping sheet 60.

The tobacco rod 10, the HAT 20, the PLA filter 30 and the MPF 40 are arranged adjacent each other. In particular, the tobacco rod 10 is adjacent to the HAT 20, the HAT 20 is adjacent to the PLA filter 30, the PLA filter 30 is adjacent to the MPF 40.

The second wrapping sheet 60 wraps respective longitudinal surfaces 11, 21 and 31 of the tobacco rod 10, the HAT 20 and the PLA filter 30. The first wrapping sheet 50 wraps a longitudinal surface 41 of the MPF 40 and overlaps the second wrapping sheet 60 at the area 70 thereof, which is arranged around the end 32 of the PLA filter 30. The end 32 of the PLA filter 30 is arranged adjacent to the MPF 40.

With reference to FIGS. 2-5, a multicomponent aerosol-forming article defining a longitudinal axis X according to the present invention is represented and indicated with reference number 200.

The components of the multicomponent aerosol-forming article 200 of FIGS. 2-5 which are similar to, or have an analogous function with respect to, those of the multicomponent aerosol-forming article 100 of FIG. 1 are indicated with the same reference number.

The multicomponent aerosol-forming article 200 includes a first, a second, a third and a fourth rod-shaped components 40, 30, 20, 10.

The first rod-shaped component includes a MPF 40. The MPF 40 comprises a first longitudinal surface 41 having a first and a second axially opposed ends 42 and 43. The MPF 40 is wrapped around the longitudinal axis in a first wrapping sheet 500.

The second component comprises a Poly Lactic Acid (PLA) filter 30.

Further, the multicomponent aerosol-forming article 200 comprises a third component comprising a Hollow Acetate Tube (HAT) 20, and a fourth component comprising a tobacco rod 10. Tobacco rod 10, HAT 20 and PLA filter 30 are arranged adjacent to each other. In particular, the tobacco rod 10 is adjacent to the HAT 20 and the HAT 20 is adjacent to the PLA filter 30. Each component 40, 30, 20 and 10 defines a longitudinal axis.

In the finished multicomponent aerosol-forming article 200 (see FIG. 4), the PLA filter 30 of the second rod-shaped component is arranged adjacent to the MPF 40. The multicomponent aerosol-forming article 200 defines a longitudinal axis X (shown in FIG. 4) and this longitudinal axis substantially coincides in the finished article to the longitudinal axes of the first, second, third and fourth components.

The second, third and fourth rod-shaped components 30, 20, 10 comprise respective second, third and fourth longitudinal surfaces 31, 21 and 11 of the PLA 30, of the HAT 20 and of the tobacco rod 10, arranged adjacent to each other and aligned along the longitudinal axis X.

The longitudinal surface of each component 30, 20, 10 defines a first and a second axially opposed ends. The first and second ends of the PLA filter 30 are indicated with 32 and 33, respectively; the first and second ends of the HAT 20 are indicated as 22, 23, respectively; and the first and second ends of the tobacco rod 10 are indicated with 12 and 13, respectively. The first end 32 of the second component 30 is in direct abutment to the second end 43 of the MPF 40 along the longitudinal axis. The second end 13 of the fourth component 10 is an end of the finished multicomponent aerosol-forming article 200, as well as the first end 42 of the first component 40 which forms a mouth piece.

A part of the second longitudinal surface 31 is wrapped around the longitudinal axis X in a second wrapping sheet 600. More preferably, a part of the second 31, third 21 and fourth longitudinal surfaces 11 is wrapped in a second wrapping sheet 600.

According to the invention, the second wrapping sheet 600 has a wrapping length along the longitudinal axis X shorter than a sum of lengths of the second longitudinal surface 31, third longitudinal surface 21 and fourth longitudinal surface 11 along the longitudinal axis X.

Preferably, the length of the second longitudinal surface 31 is equal to about 18 millimeters, the length of the third longitudinal surface 21 is equal to about 8 millimeters and the length of the fourth longitudinal surface 11 is equal to about 12 millimeters. Furthermore, preferably the length of the first longitudinal surface 41 is equal to about 7 millimeters.

The fourth longitudinal surface 11 at the second end 13 is completely covered by the second wrapping sheet 600. Thus an edge of the fourth longitudinal surface 11 is aligned with an edge of the second wrapping sheet 600. The second end 13 of the fourth component 10, which defines an end of the aerosol-forming article 200, is therefore completely covered by the second wrapping sheet 600.

The second longitudinal surface 31 at the first end 32 is not completely covered by the second wrapping sheet 600. There is a portion 34 of the second longitudinal surface 31 that is not covered by the second wrapping sheet for a given length.

In FIG. 5 the difference between the length of the second longitudinal surface 31 and the wrapping length of the second wrapping sheet 600 is indicated with 601.

Therefore, the portion 34 of the second longitudinal surface 31 at the first end 33 of the second component is free of the second wrapping sheet 600 (see FIG. 5).

The second wrapping sheet 600 is wrapped around the plurality of components 10, 20 and 30 aligned along the longitudinal axis X. In particular, the second wrapping sheet 600 is wrapped around the longitudinal surfaces 11 and 21 of the tobacco rod 10 and of the HAT 20, and around a part of the longitudinal surface 31 of PLA filter 30 (that is, the longitudinal surface 31 of PLA filter 30 minus the portion 34).

The first wrapping sheet 500 is wrapped for a length along the longitudinal axis around the first component 40. Preferably, the first wrapping sheet 500 is wrapped around the first longitudinal surface 41 so as to cover it completely. Further, the first wrapping sheet is also wrapped for an overlapping length on the second wrapping sheet 600. The second component 30 is thus wrapped, for a given portion having the length of the overlapping, in the first wrapping sheet 500. Preferably, the overlapping length is longer than the length 601 so that the second longitudinal surface 31 is completely covered by either the second wrapping sheet 600 or by the first wrapping sheet 500.

Preferably, the first longitudinal surface 41 at the first end 42 is completely covered by the first wrapping sheet 500. Thus an edge of the first longitudinal surface is aligned with an edge of the first wrapping sheet 500. Preferably, the first end 42 of the first component 40 forms a mouth piece.

FIG. 2 shows a first step of the method of fabrication of the multicomponent aerosol-forming article 200, wherein the tobacco rod 10, the HAT 20 and the PLA 30 filter are wrapped in the second wrapping sheet 600.

The length of the second wrapping sheet 600 along the longitudinal axis is shorter than the sum of the lengths of the longitudinal surfaces 11, 21 and 31 of the tobacco rod 10, HAT 20 and PLA 30 filter.

In the case of the FIG. 2, the second wrapping sheet 600 has one of its ends aligned with the end 13 of the tobacco rod 10, which is not in contact with the MPF 40.

FIG. 3 shows a second step of the method of fabrication of the multicomponent aerosol-forming article 200, wherein the MPF 40 is arranged in positive and direct contact with the end 32 of the PLA filter 30.

FIG. 4 shows a third step of the method of fabrication of the multicomponent aerosol-forming article 200, wherein the first wrapping sheet 500 is wrapped around the MPF 40, the portion 34 of the PLA filter 30 and around a part of the second wrapping sheet 600.

Multicomponent aerosol-forming articles 100, 200 may be inserted in packages including a plurality of aerosol-forming articles, such as 2, 5, 7 and so on.

The invention claimed is:

1. A multicomponent aerosol-forming article defining a longitudinal axis, the article comprising:

a first rod-shaped component comprising a first longitudinal surface having a first and a second axially opposed ends, said first longitudinal surface being at least partially wrapped around the longitudinal axis in a first wrapping sheet;

a second rod-shaped component comprising a second longitudinal surface having a first and a second axially opposed ends, said second longitudinal surface being at least partially wrapped around the longitudinal axis in a second wrapping sheet, no additional sheet or layer being interposed between the second rod-shaped component and the second wrapping sheet, the first end of the second rod-shaped component being in direct abutment to the second end of the first rod-shaped component along said longitudinal axis;

wherein a portion of said second longitudinal surface at said first end of said second rod-shaped component is free of said second wrapping sheet;

wherein said first wrapping sheet is wrapped for at least an overlapping length along the longitudinal axis on the second wrapping sheet;

wherein the portion of said second longitudinal surface at said first end of said second rod-shaped component free of said second wrapping sheet has a length along said longitudinal axis comprised between about 0.3 millimeters and about 3 millimeters; and wherein said first rod-shaped component comprises a mouthpiece filter and the second rod-shaped component comprises a filter component, the mouthpiece filter and the filter component being in direct abutment.

2. The multicomponent aerosol-forming article according to claim 1, wherein said second end of said second rod-shaped component defines an end of said multicomponent aerosol-forming article.

3. The multicomponent aerosol-forming article according to claim 1, wherein said second wrapping sheet is wrapped around a plurality of components aligned along said longitudinal axis.

4. The multicomponent aerosol-forming article according to claim 1, wherein said second wrapping sheet has a wrapping length along said longitudinal axis shorter than a sum of lengths of aligned longitudinal surfaces along said longitudinal axis of a number of components wrapped in said second wrapping sheet.

5. The multicomponent aerosol-forming article according to claim 1, wherein said filter component comprises a Poly Lactic Acid filter.

6. The multicomponent aerosol-forming article according to claim 1, wherein the second wrapping sheet defines an inner diameter when wrapped around said second longitudinal surface, and wherein the inner diameter is bigger or equal to a diameter of the second rod-shaped component.

7. The multicomponent aerosol-forming article according to claim 1, wherein a ratio between a length of the portion of said second longitudinal surface at said first end of said second rod-shaped component free of said second wrapping sheet and a length of the second rod-shaped component is comprised between about 0.015 and about 0.2.

8. The multicomponent aerosol-forming article according to claim 1, wherein the overlapping length is comprised between about 3 millimeters and about 20 millimeters.

9. A package containing a plurality of multicomponent aerosol-forming article realized according to claim 1.

10. The multicomponent aerosol-forming article according to claim 1, wherein the mouthpiece filter comprises a cellulose acetate filter plug.

11. The multicomponent aerosol-forming article according to claim 1, further comprising a third rod-shaped component comprising a third longitudinal surface having a first and a second axially opposed ends, said third longitudinal surface being at least partially wrapped around the longitudinal axis in the second wrapping sheet, the first end of the third component being in direct abutment to the second end of the second rod-shaped component along said longitudinal axis.

12. The multicomponent aerosol-forming article according to claim 11, wherein the said third component comprises a Hollow Acetate Tube.

13. The multicomponent aerosol-forming article according to claim 12, further comprising a fourth rod-shaped component comprising a fourth longitudinal surface having a first and a second axially opposed ends, said fourth longitudinal surface being at least partially wrapped around the longitudinal axis in the second wrapping sheet, the first end of the fourth component being in direct abutment to the second end of the third component along said longitudinal axis.

14. The multicomponent aerosol-forming article according to claim 13, wherein one of the third component or the fourth component comprises an aerosol-forming substrate.

15. The multicomponent aerosol-forming article according to claim 14, wherein the aerosol-forming substrate comprises volatile tobacco flavor compounds.

16. The multicomponent aerosol-forming article according to claim 13, wherein one of the third component or the fourth component further comprises a volatile flavour generating component.

17. The multicomponent aerosol-forming article according to claim 16, wherein the volatile flavour generating component is coupled to a fibrous support element.

18. The multicomponent aerosol-forming article according to claim 13, wherein one of the third component or the fourth component comprises a tobacco rod.

19. The multicomponent aerosol-forming article according to claim 1, wherein said second longitudinal surface at said second end is completely covered by said second wrapping sheet, so that an edge of said second longitudinal surface is aligned with an edge of said second wrapping sheet.

* * * * *